US005695261A

United States Patent [19]

Slesinger et al.

[11] Patent Number: 5,695,261

[45] Date of Patent: Dec. 9, 1997

[54] INTEGRALLY POWERED MODULAR FURNITURE

[76] Inventors: Bruce M. Slesinger, 70 Lundy's La., San Francisco, Calif. 94110; Thomas L. Collom, 1449 Willard St., San Francisco, Calif. 94117; Frank Neidhardt, 320 Webster St., Palo Alto, Calif. 94301

[21] Appl. No.: 631,462

[22] Filed: Apr. 12, 1996

[51] Int. Cl.[6] ..... A47B 81/06

[52] U.S. Cl. ..... 312/223.6; 439/116; 439/120

[58] Field of Search ..... 312/223.1, 223.6; 439/110, 116, 117, 120, 121

[56] References Cited

U.S. PATENT DOCUMENTS

| | | | |
|---|---|---|---|
| 3,273,103 | 9/1966 | Ericson | 439/121 |
| 3,639,885 | 2/1972 | Yoshiya et al. | 339/21 R |
| 3,836,936 | 9/1974 | Clement | 339/21 |
| 3,862,523 | 1/1975 | Eaton | 52/27 |
| 4,029,378 | 6/1977 | Bolis | 339/22 B |
| 4,203,639 | 5/1980 | VandenHoek et al. | 339/22 R |
| 4,489,995 | 12/1984 | Barr | 312/223.6 |
| 4,549,777 | 10/1985 | Schnidler | 312/223.6 |
| 4,776,809 | 10/1988 | Hall | 439/116 |
| 4,973,796 | 11/1990 | Dougherty et al. | 174/48 |
| 5,022,720 | 6/1991 | Fevig et al. | 312/223 |
| 5,057,978 | 10/1991 | Conti | 362/125 |
| 5,348,485 | 9/1994 | Briechle et al. | 439/110 |
| 5,425,648 | 6/1995 | Farham | 439/116 |

OTHER PUBLICATIONS

Shelf Light brochure, StyleMark, Inc. Minneapolis, MN, 1996.

*Primary Examiner*—Peter M. Cuomo
*Assistant Examiner*—Gerald A. Anderson
*Attorney, Agent, or Firm*—Kevin P. B. Johnson; Michael J. DeHaemer, Jr.; Fish & Neave

[57] ABSTRACT

A modular furniture system is provided having vertical standards with internal conductors. The conductors are coupled to a source of low voltage electrical power such that adjacent vertical standards are of differing electrical polarity. Brackets for use in the modular furniture system are designed to make electrical contact with the internal conductors when a bracket is engaged in a vertical standard. An electrical device, such as a light fixture, is coupled between a pair of brackets engaged with adjacent vertical standards, thus, energizing the electrical device. Alternative embodiments are provided for use in merchandising displays and office partition systems.

15 Claims, 17 Drawing Sheets

INTEGRALLY POWERED MODULAR FURNITURE

BACKGROUND OF THE INVENTION

The present invention relates generally to electrified wall structures and particularly to wall structures including low voltage buses for powering low voltage light fixtures in a merchandising or office partitioning system.

In a retail environment it is common for merchandise to be displayed on a modular system of adjustable shelves and display racks. The display system includes vertical supporting members or channels, or standards, which may be fixed to a wall or between the floor and ceiling. Alternatively, the standards may be mounted to a portable base so that the unit may be repositioned with relative ease.

Display shelves or racks include brackets specifically designed to engage the standards at any one of a plurality of locations. Typically, this is accomplished via tongues and notches on the brackets mating with slots or holes in the face of the vertical standard. The shelves and racks may then be easily repositioned by disengaging the brackets from one location on a vertical standard and re-engaging the brackets at a different location.

To attract customers it is important that a merchandise display be aesthetically pleasing so as to present the merchandise to a potential customer in a highly visible and attractive manner. In many retail establishments, the major source of lighting is wide area illumination provided by ceiling mounted light fixtures, supplemented with spot lighting for accent and highlighting of specific areas or merchandise. When non-illuminated shelving is used, shelves nearer the ceiling cast shadows which results in less than optimal lighting of merchandise on lower shelves. It is therefore desirable to provide a means of illuminating merchandise on lower shelving or racks of a display.

Prior art attempts to provide illuminated display systems have been less than satisfactory either because they are aesthetically displeasing or are cumbersome and inflexible. Early attempts at providing illuminated shelving were essentially ordinary light fixtures mounted to the underside of a display shelf. A conventional power cord was then run from the light fixture to an outlet. Preferably, the cord was strung under shelving, behind merchandise on display, or otherwise hidden from a customer's view so that it would not detract from an otherwise pleasing display. For a system of fixed shelving, or shelving with a limited range of adjustment, the power cord may be hidden from view fairly successfully. However, when using vertically adjustable shelving, the power cord would typically droop or otherwise be exposed to view.

Previous systems have attempted to alleviate some of these difficulties by providing an outlet or power source that may be moved within a limited range so that it is located adjacent to a shelf containing a light fixture. For example, U.S. Pat. No. 5,022,720 discloses a bakery display case that provides vertically adjustable shelves having a light fixture mounted on the front. A plurality of electrical outlets are slidably mounted in a channel at the rear of the display area. The outlets may be relocated vertically within a limited range so that an outlet is juxtaposed adjacent to each shelf, to help minimize power cord exposure.

Alternatively, U.S. Pat. Nos. 4,973,796 and 5,425,648, disclose vertical shelf standards including internal conductors. The conductors are housed within the standards in such a way that an ordinary shelf bracket would not contact the conductors. Specially designed couplers include spring wires or clips that contact the internal conductors when the coupler is inserted into the shelf standard. In a display unit according to either of these patents, an illuminated shelf may be inserted into and supported by a pair of shelf standards and a special electrical coupler cabled to a light fixture may be inserted into one of the shelf standards just below the shelf itself to help minimize cable exposure.

While the aforementioned patents solve the problem of providing power to shelf light fixtures, they involve the use of shelf standards and connectors that are electrically and mechanically complex and are therefore more costly to manufacture than conventional shelf standards, and are more susceptible to failure due to mechanical fatigue and wear. Furthermore, electrical connections to the internal conductors of the shelf standards is made by a separate, specially designed connector located adjacent to, but not integral with, a supporting bracket for an illuminated shelf, so the power cord is not entirely hidden from view.

In view of the foregoing, it would be desirable to provide a modular furniture and shelving system including illuminated shelving and other powered fixtures wherein electrical connections for energizing the illuminated shelves and other powered fixtures do not detract from the aesthetic appeal of the system.

It would also be desirable to provide a modular furniture and shelving system wherein the components thereof are electrically and mechanically simple in design and therefore relatively inexpensive to manufacture.

It would further be desirable to provide a modular furniture and shelving system employing low voltage to energize powered portions thereof so as to minimize the possibility of electrical shock and other electrical hazards.

In addition, it would be desirable to provide a modular furniture and shelving system in which power coupling between a vertical member and a powered fixture is integral to the fixture support brackets.

SUMMARY OF THE INVENTION

It is therefore an object of the invention to provide a modular furniture and shelving system including illuminated shelving and other powered fixtures wherein electrical connections for energizing the illuminated shelves and other powered fixtures do not detract from the aesthetic appeal of the system.

It is also an object of the invention to provide a modular furniture and shelving system wherein the components thereof are electrically and mechanically simple in design and therefore relatively inexpensive to manufacture.

It is a further object of the invention to provide a modular furniture and shelving system employing low voltage to energize powered portions thereof so as to minimize the possibility of electrical shock and other electrical hazards.

It is an additional object of the invention to provide a modular furniture and shelving system in which power coupling between a vertical member and a powered fixture is integral to the fixture support brackets.

These and other objects and advantages of the present invention are realized by providing a modular assembly including vertical shelving standards including an internal electrical conductor or bus. The conductors are coupled to a source of low voltage electrical power so that adjacent vertical standards are of opposite polarity. Shelves and light fixtures according to the invention use shelf support brackets covered with an electrical insulator except at the end designed for mating with the shelf standard. A light fixture or other electrical device is coupled between a pair &shelf brackets so that when the brackets are inserted into a pair of adjacent shelf standards the brackets contact the conductor internal to the standards, thus providing power to the light fixture.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
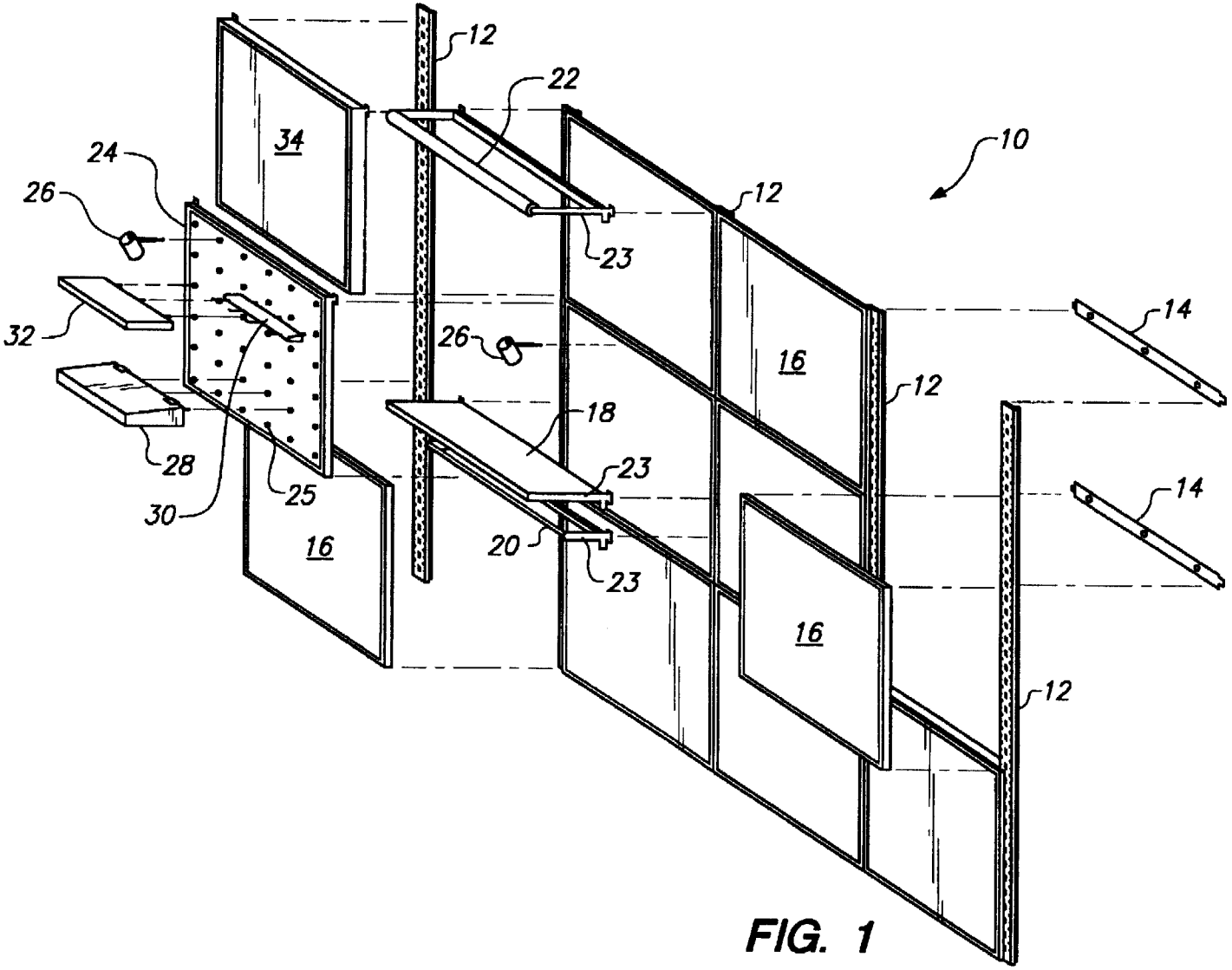
FIG. 1 shows an exploded perspective view of an illustrative merchandise display constructed in accordance with the principles of the present invention.

Referring first to FIG. 1, modular furniture system 10 includes a grid like framework formed by vertical members 12 and horizontal members 14. Vertical members 12 are typically affixed to a wall or between sills (not shown) attached to the floor and ceiling. Panels 16 are removably mounted to vertical members 12 to substantially conceal the supporting framework and supporting wall as well as to provide an aesthetically pleasing background for the merchandise to be displayed. Modular furniture such as lighted shelf 18, clothes rack 20, and light fixture 22 include brackets 23 which are designed to removably engage vertical members 12, allowing the furniture pieces to be positioned as desired. Similarly, smaller items such as spot-light 26 hooks 30 and shelf 32 may be mounted in sockets located in horizontal members 14.

Additionally, powered panel 24 and light box 34 may be removably mounted to vertical members 12 to replace one or more of panels 16. Powered panel 24, which generally resembles a portion of peg-board, provides a plurality of sockets 25 for supporting and powering smaller modular pieces such as spot-light 26 and illuminated case 28. Non-electrical pieces, such as hooks 30 and shelf 32, may also be used with powered panel 24. Furniture pieces such as spot-light 26, hooks 30, and shelf 32 may also be used with horizontal members 14. Light box 34 includes a translucent face and an internal light source, and may be used for displaying posters and advertising displays.

Figure 2:
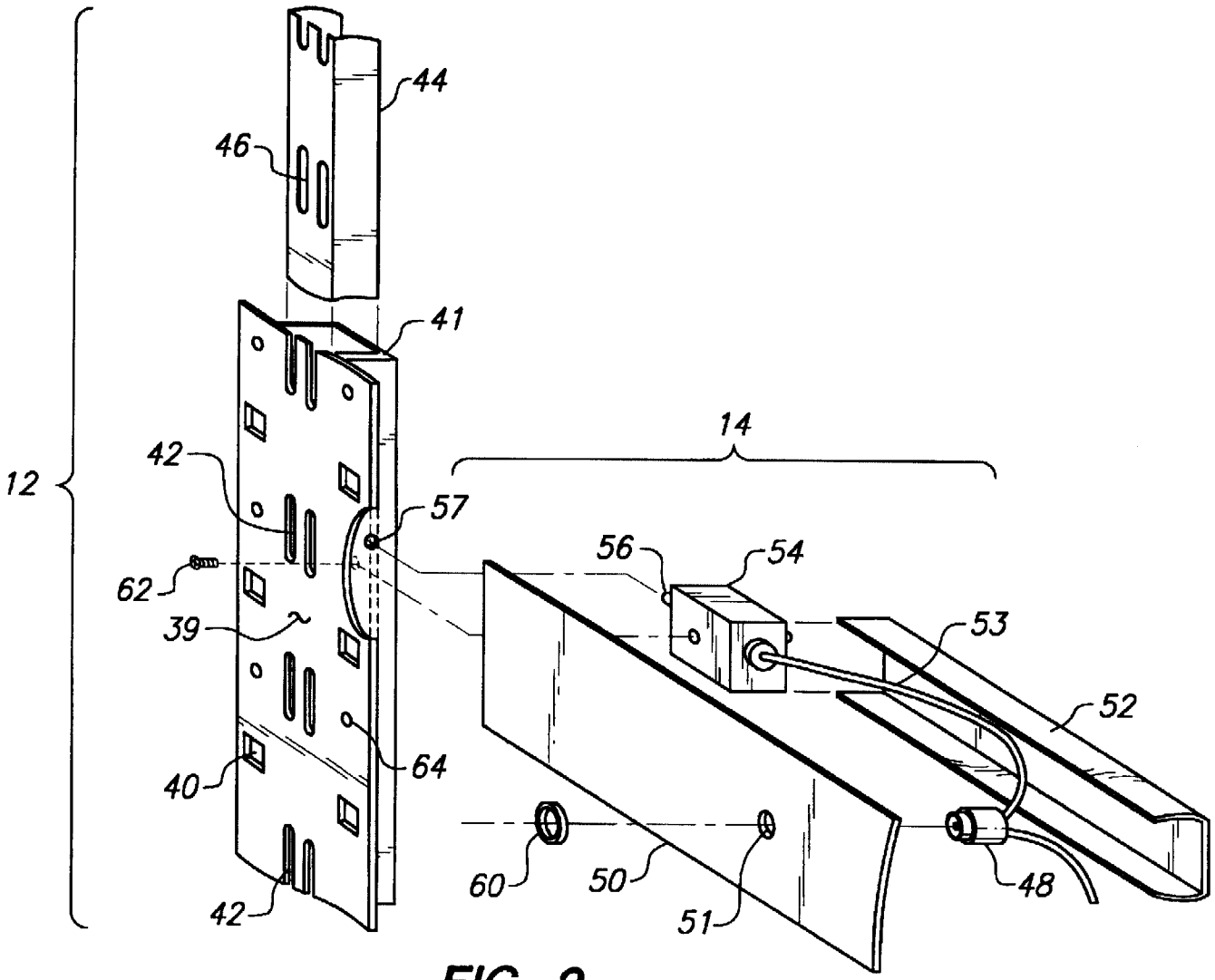
FIG. 2 is a detailed view depicting an exemplary method of electrically and mechanically coupling a horizontal member to a vertical shelf standard.

Referring now to FIG. 2, the design of an illustrative embodiment of vertical member 12. Vertical member 12 generally comprises elongated supporting member 39 and cap 41 which together form a box channel. Preferably, supporting member 39 and cap 41 are manufactured from aluminum, steel, or other suitable material, and may be formed using either a machining or extruding process. Slot shaped openings 42 are provided in supporting member 39 to accept a shank portion of a support bracket for a modular furniture piece. Further openings, such as rectangular holes 40 are designed to mate with corresponding protrusions on a rear portion of modular wall panels 16, as shown in FIG. 1. Supporting member 39 and cap 41 are also powder coated to electrically insulate vertical member 12 from other components of the modular furniture system.

Conductor 44 is disposed immediately behind support member 39, and is preferably composed of a conductive material, such as brass or copper, folded or extruded to have a U-shaped cross section. Openings 46 are then punched or machined into conductor 44 so that when conductor 44 is juxtaposed behind support member 39, openings 46 are aligned with openings 42 in support member 39. The openings in support member 39 and conductor 44 provide a means for a shank portion of bracket 23 to mechanically and electrically engage vertical member 12 as shown in FIG. 3C. Alternatively, only the outer surface of supporting member 39 is powder coated and the inner surface is left bare, or is nickel plated, to act as a conductor so that conductor 44 may be omitted.

Figure 3B:
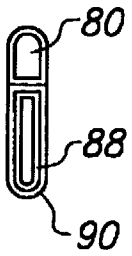
FIGS. 3A through 3C show detailed views of the construction of a support bracket in accordance with the principles of the present invention.
Figure 3A:
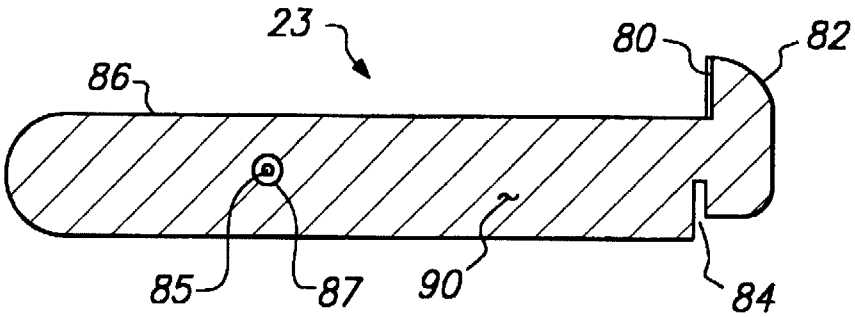
Figure 3C:
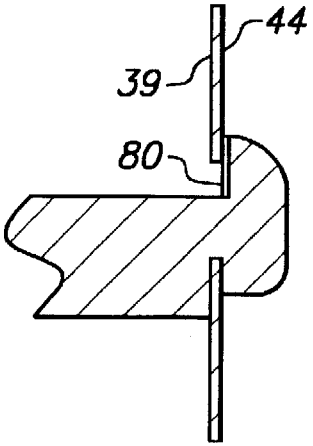

Referring first to FIGS. 3A and 3B, side and front elevations, respectively, of an illustrative embodiment of bracket 23 are shown. Bracket 23 is typically a flat, elongated portion of steel or aluminum having a shape similar to that shown in FIG. 3A. Bracket 23 includes cantilever portion 86 and a shank portion generally indicated by reference character 82. Shank portion 82 includes vertical face 80 and notch 84, which act to engage vertical member 12 and hold bracket 23 in a cantilevered fashion. Cantilever portion 86 may optionally have screw holes bored through for affixing bracket 23 to various modular furniture pieces.

Bracket 23 is then provided conductive metal plating 88, for example, nickel plating, to improve its electrical conductivity. A tough, insulative layer 90, such as provided by an industrial powder coating rated for interior and exterior use, is then applied over nickel plating 88. Powder coating 90 is applied over the entire surface of bracket 23 except for face 80 and area 87 around screw hole 85. Nickel plating 88 is left exposed around screw hole 85 so that a wire lead from an electrical fixture can be electrically connected to bracket 23, as discussed hereinbelow in connection with FIG. 6. Nickel plating 88 is also left exposed at face 80 to provide electrical contact between bracket 23 and conductor 44 of vertical member 12 as shown in FIG. 3C.

FIG. 3C is a vertical cross-section through vertical member 12 showing how bracket 23 and vertical member 12 interlock. As shown, shank portion 82 of bracket 23 passes through slots in supporting member 39 and conductor 44 of vertical member 12. When bracket 23 is lowered, notch 84 in bracket 23 engages the bottom portion of the slot in vertical member 12. At the same time, shank portion 82 extends above the top portion of the slot, thereby providing mechanical support for cantilever portion 86 and also providing electrical contact between the bare nickel plating on surface 82 and conductor 44.

Referring back to FIG. 2, horizontal member 14 is structurally similar to supporting member 39 of vertical member 12. Horizontal member 14 includes face portion 50 having a number of holes 51 bored through at a regular intervals along its length. Electrical sockets 48, similar to a socket for a phono or stereo headphones, are mounted in holes with nuts 60. Electrical connector blocks 54 are mounted at both ends of horizontal member 14 and include spring pin 56.

As shown in FIG. 2, the box-beam shaped portion of vertical member 12 has a plurality of holes bored through its sides, thereby exposing a small portion of conductor 44. Horizontal member 14 is screwed or bolted to vertical member 12 with screw 62 at screw hole 64. When properly attached, spring pin 56 is biased against that portion of conductor 44 exposed via hole 57, and making electrical contact with conductor 44. Wiring 53 couples sockets 48 to connector block 54 in a series configuration to provide power to sockets 48. Channel 52 attached to face 50 encloses and protects sockets 48, wiring 53 and connector blocks 54, while adding rigidity to horizontal member 14. As with vertical member 12, face 50 and channel 52 are preferably insulated by a powder coating.

Figure 4B:
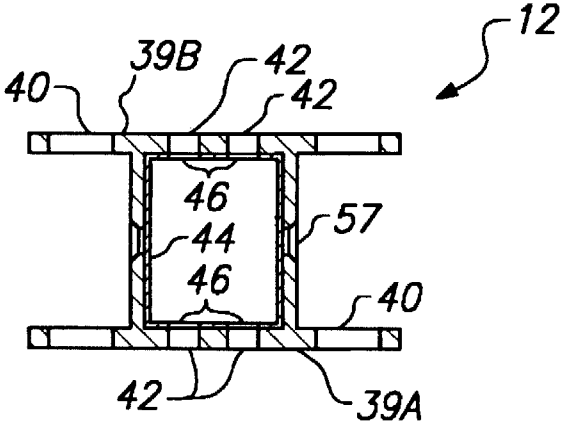
FIGS. 4A through 4D show alternative exemplary embodiments of the vertical shelf standards of FIGS. 1 and 2.
Figure 4D:
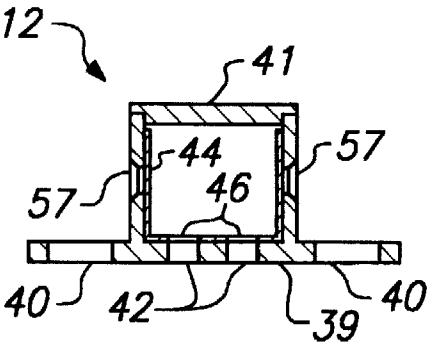
Figure 4A:
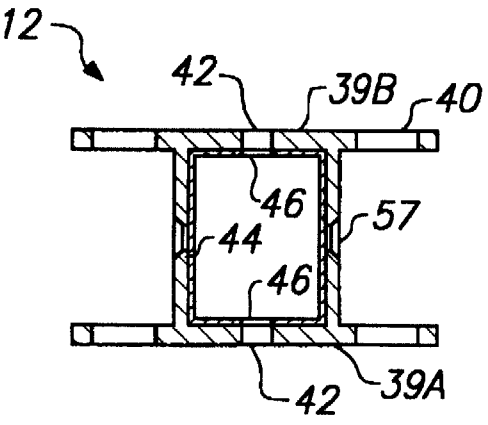
Figure 4C:
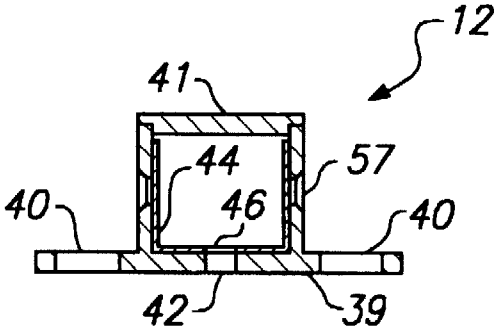

Cross sectional views of various illustrative embodiments of vertical member 12 are shown in FIGS. 4A through 4D. The cross section shown in FIG. 4D corresponds to the embodiment of vertical member 12 shown in FIG. 2, including two columns of slots 42 in supporting member 39 and slots 46 in conductor 44. Supporting member 39 also includes side holes 57, panel mounting holes 40 and cap 41. An embodiment of vertical member 12 having a cross section as shown in FIG. 4C, is the same as that shown in FIG. 4D, with the exception, that the embodiment of FIG. 4D has two columns of slots 42 whereas the embodiment of FIG. 4C has only a single column of slots. Furthermore, the embodiments illustratively depicted in FIGS. 4A and 4B, are constructed similarly to those shown in FIGS. 4C and 4D, respectively, except that in FIGS. 4A and 4B the vertical element also have slots in opposing sides **39*a* and 39*b*. Thus, the embodiments of FIGS. 4A and 4B may be used in situations wherein both the front and back of vertical members 12** may be visible, such as when a modular display is located in the center of a retail store.

Figure 5A:
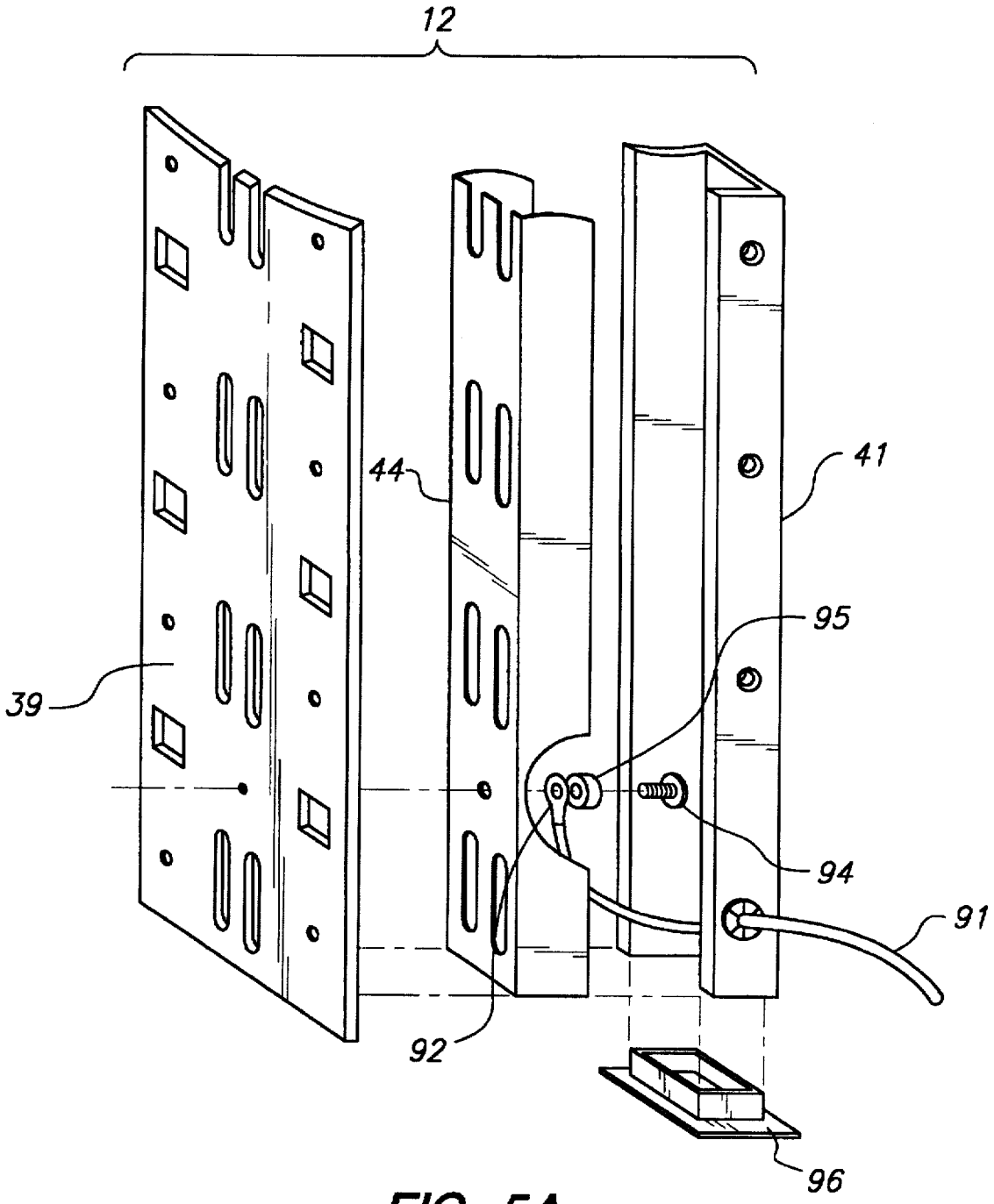
FIGS. 5A and 5B are detailed views showing two illustrative means of connecting a vertical shelf standard to a power source.

FIG. 5A is a detailed drawing showing alternative means of energizing conductors 44 of vertical members 12. In the embodiment of FIG. 5A, a wire 91 is screwed to a bottom portion of conductor 44 and strung to a power source for the modular furniture system. This method is mechanically and electrically simple and therefore low cost; however, each vertical member must be wired individually making set-up more prone to wiring errors.

Figure 5B:
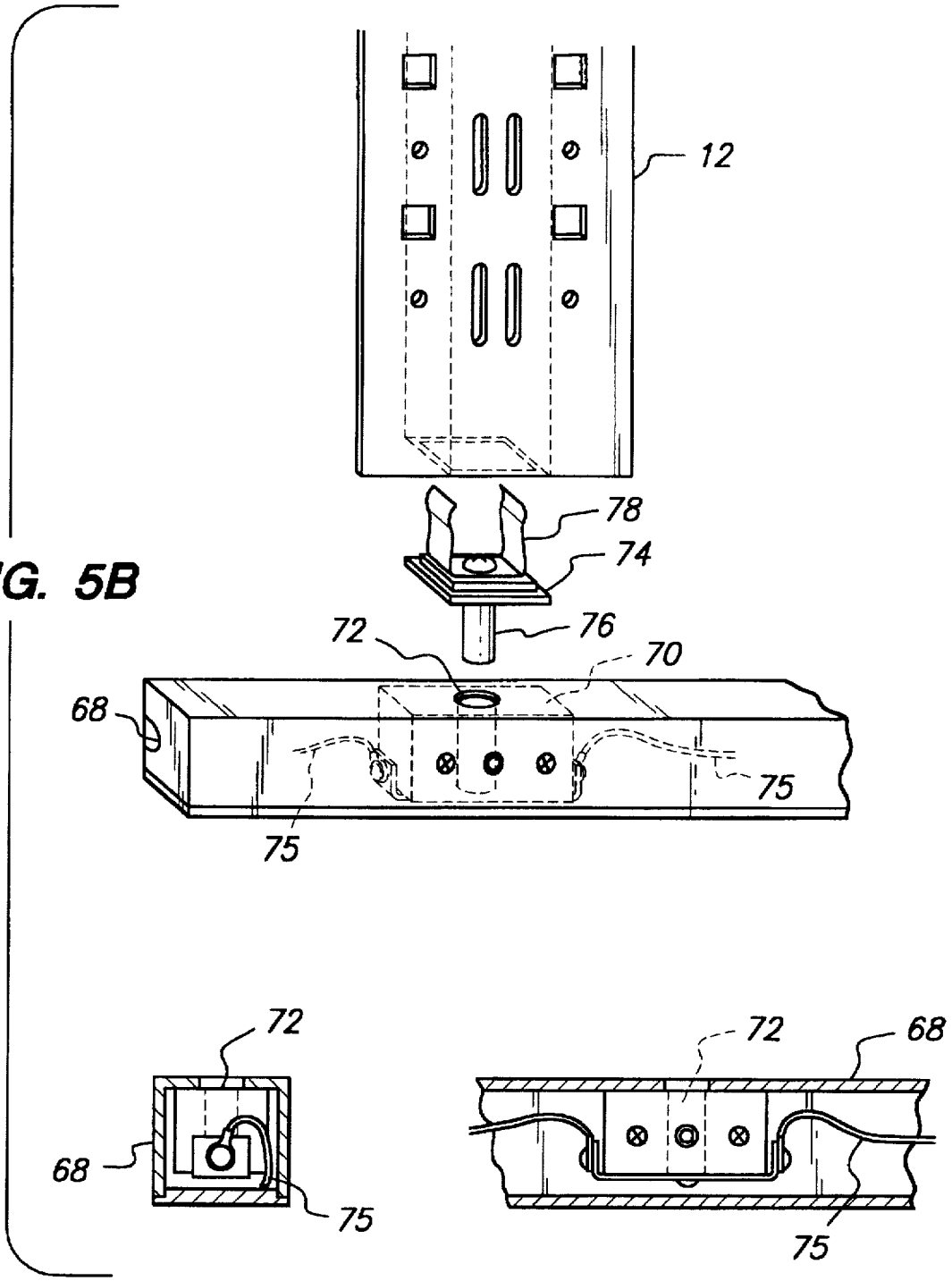

In an alternative embodiment shown in FIG. 5B, wherein sill member 68 is provided with plastic blocks 70 mounted below holes bored through an upper surface of sill 68 at regular intervals along its length. Plastic blocks 70 include socket 72 formed from a brass, or other suitable material, receptacle pressed into a hole in the block. Sockets 72 may then be connected with wire 75 in a daisy chain fashion such that adjacent sockets are of opposite polarity. In this embodiment, each vertical member 12 has a bottom cap 74 including brass pin 76 and bracket 78. Pin 76 is electrically connected to bracket 78, which in turn is coupled to conductor 44 of vertical member 12. Conductor 44 may therefore be energized by simply plugging pin 76 into corresponding socket 72 in sill 68. This provides essentially "fool-proof" wiring, but at a slightly elevated price due to the increased complexity involved in manufacturing sill 68.

Figure 6:
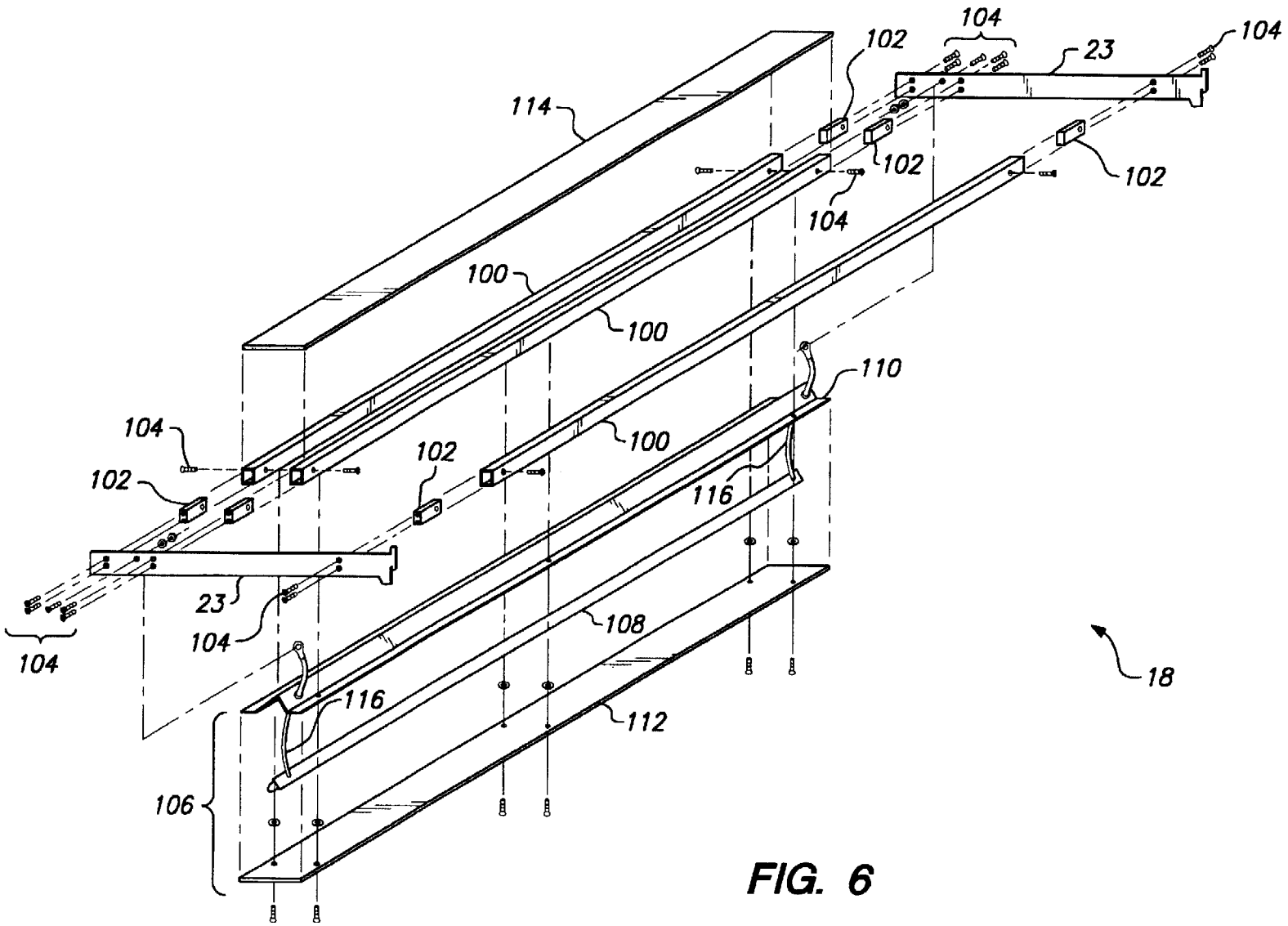
FIGS 6 and 7 are exploded perspective views of illustrative embodiments of an under-shelf and a stand-alone light fixture, respectively.

Referring now to FIG. 6, the design of an illustrative embodiment of shelf support 18, including light fixture 106, is described. Brackets 23 are attached to each end of cross supports 100 using insulative blocks 102. Preferably, cross supports 100 are made of aluminum and insulator blocks 102 are made of a machinable plastic such as Nylon or Delrin. Light fixture 106, including lighting element 108, reflector 110, and bezel 112 is then attached to cross supports 100. Electrical leads 116 provided at either end of light fixture 106 are connected to corresponding brackets 23 through screw holes 85 such that leads 116 are electrically coupled to a portion of the nickel plating (see FIGS. 3A–3C) exposed through powder coating 90 at area 87. Heat reflector 114 provides thermal insulation to prevent damage to a shelf resting on the cantilever portions of brackets 23.

Figure 7:
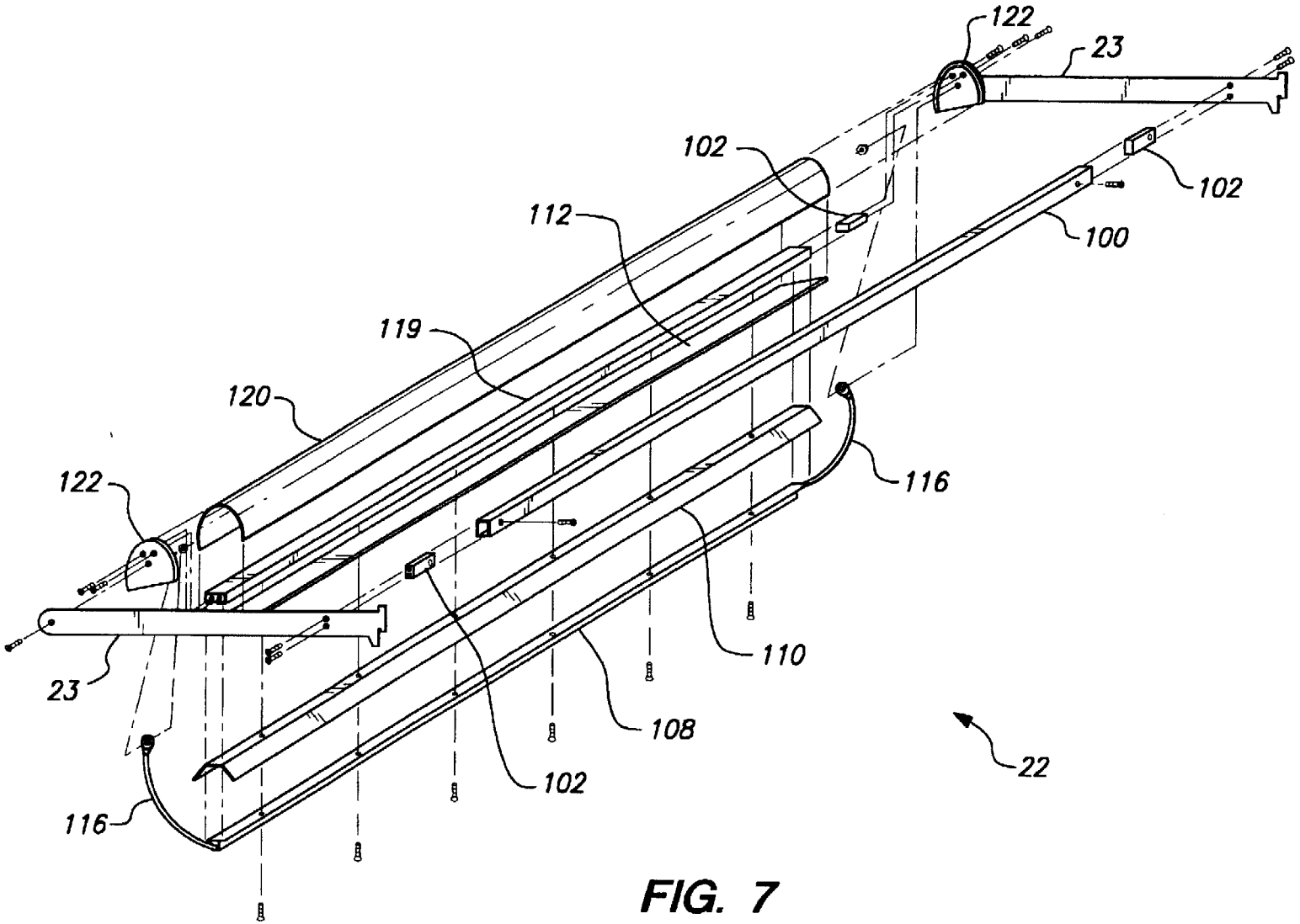

The light fixture 22 of FIG. 7 is similar in most respects to light fixture 18 of FIG. 6, including brackets 23, cross supports 100, and insulators 102. Lighting element 108 and reflector 110 are mounted to cross support 119. Lens 112, cross support 119, and cover 120 are in turn mounted between end pieces 122 to form a lamp module. End pieces 122 are pivotally mounted to brackets 23 such that the lamp module may be rotated around an axis running through its length.

Figure 8:
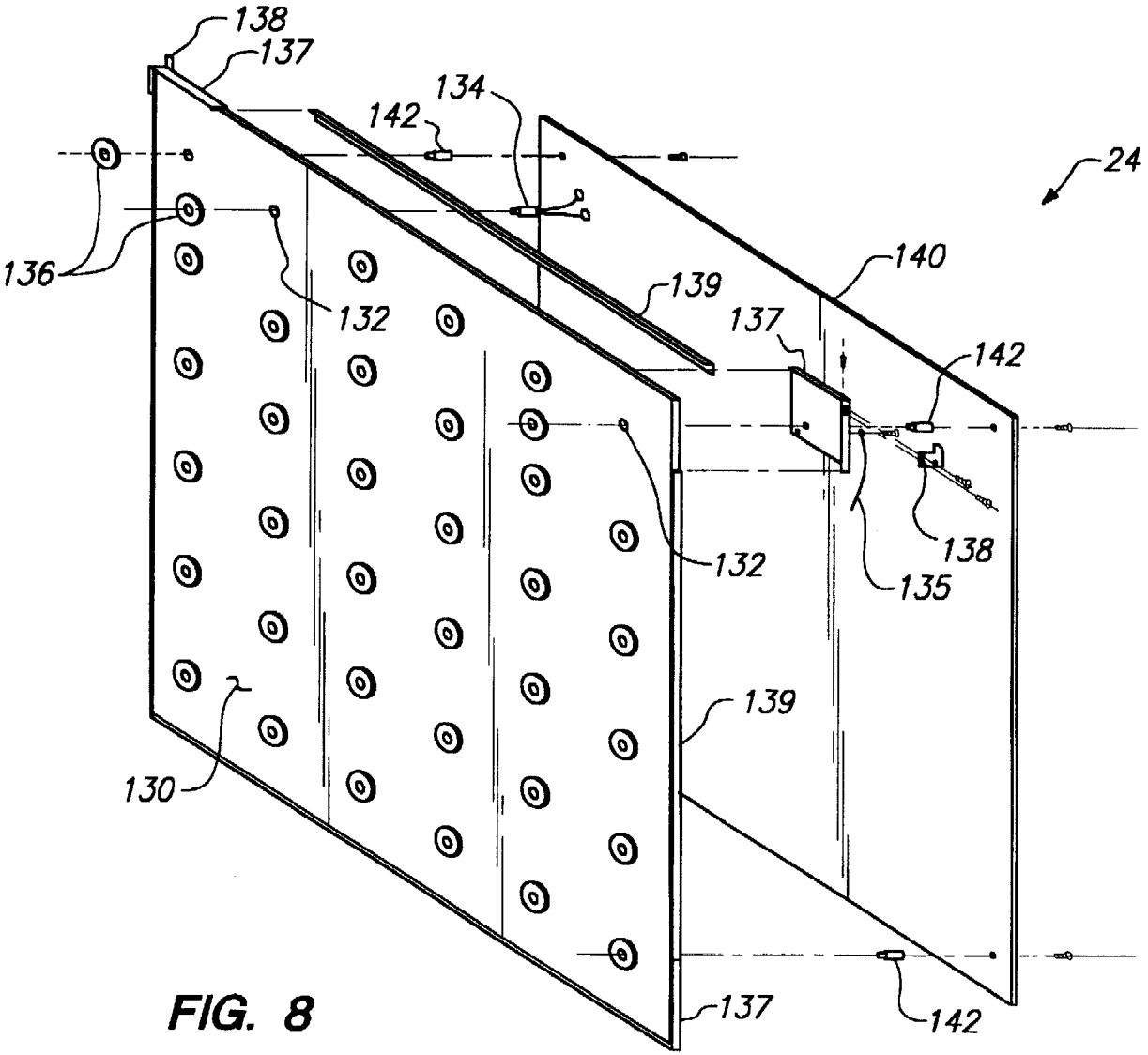
FIGS. 8 and 9 are, respectively, a perspective view of an illustrative powered panel and an electrical socket used therein.
Figure 9:
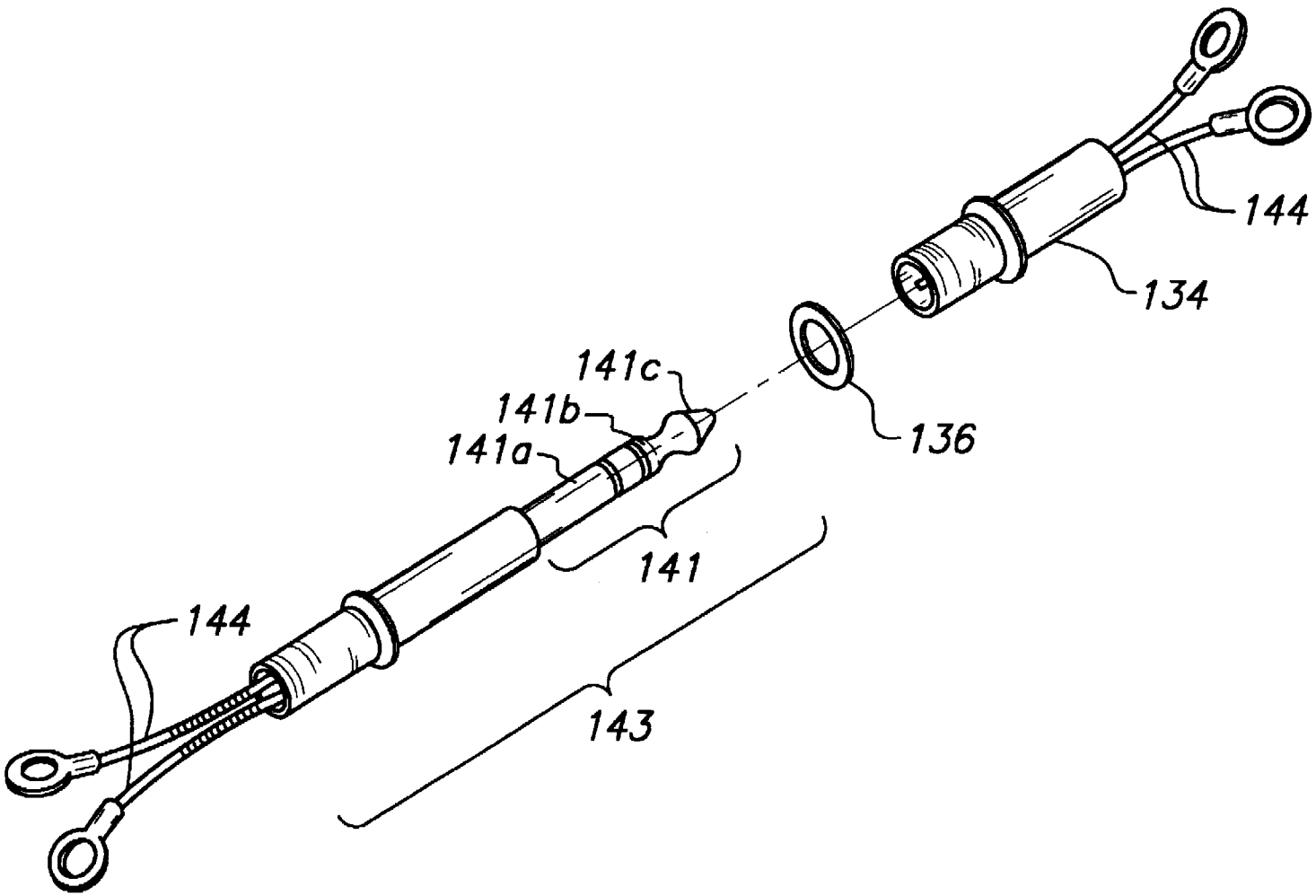

FIG. 8 is more detailed view of powered panel 24 of FIG. 1. Powered panel 24 comprises sheet 130, made of plastic or other suitable material, having a plurality of holes 132. Although the holes are laid out in a rectangular grid in FIG. 8 this need not be the case. Each hole in plastic sheet 130 is fitted with a socket 134 held in place by nut 136. As shown in more detail in FIG. 9, socket 134 resembles a panel-mount, ¼" phono jack, which may be secured to a panel with nut 136. Jack 143 comprises tip portion 141 including two or more conductors, such as conductors **141*a*, 141*b*, and 141*c*, which connect with corresponding contacts internal to socket 134. When inserted into a socket 134 jack 143 may provide electrical power to a device connected to leads 144. Additionally, jack 143 may act as a mounting device for small electrical fixtures such as spot-light 26 of FIG. 1 or desk lamp 170 of FIG. 10**.

Returning now to FIG. 8, conductive corner pieces 137 are attached to the corners of plastic sheet 130 to provide reinforcement of the sheet and to provide a place to attach brackets 138. Wiring, a portion of which is indicated by reference numeral 135, electrically couples sockets 134 to brackets 138. A back cover 140, mounted to plastic sheet 130 with spacers 142, covers and protects sockets 134 and wiring 135. Additionally, trim pieces 139 may be attached to provide powered panel 24 with a more finished appearance.

Figure 10:
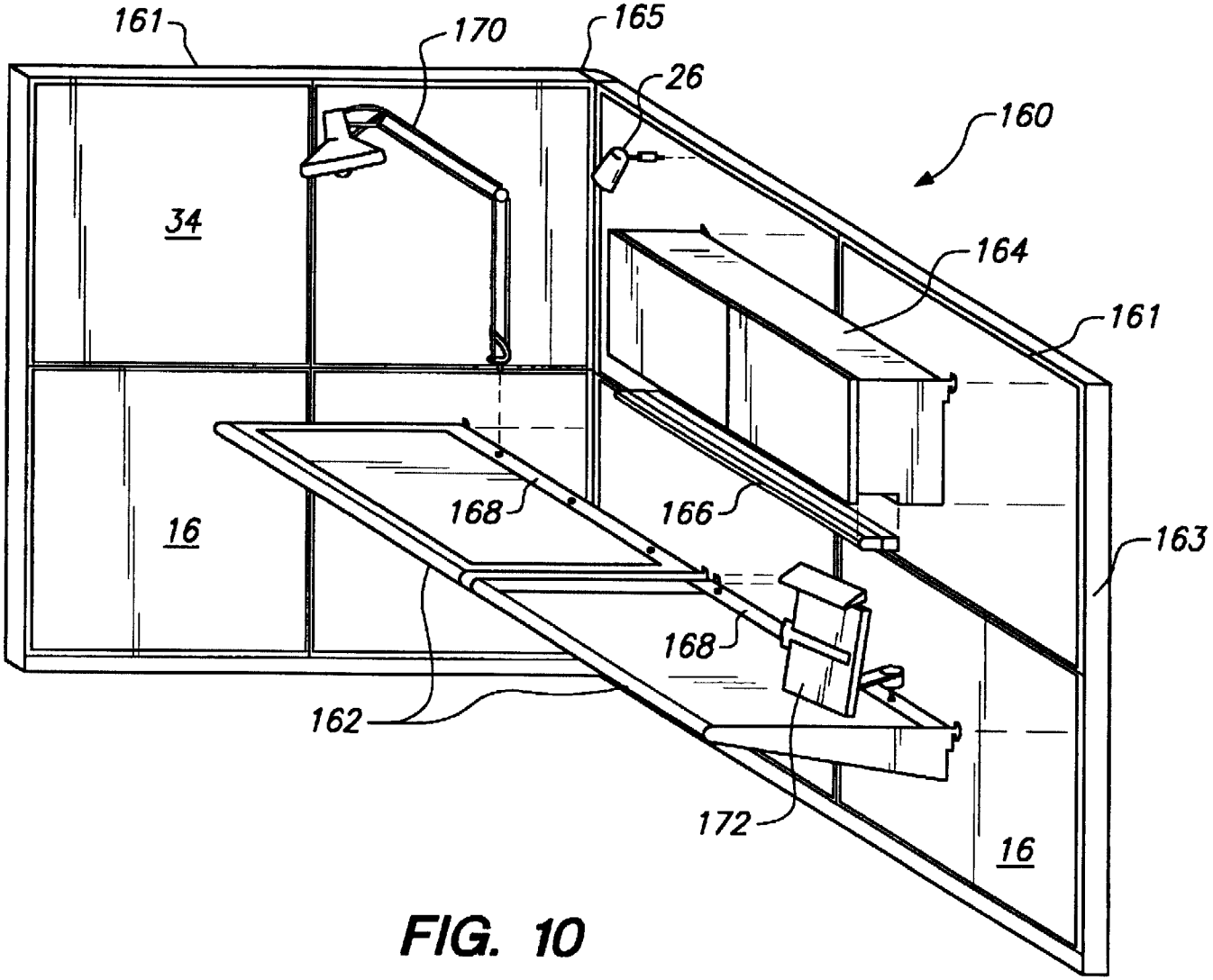
FIG. 10 is an exploded, perspective view of an illustrative office partition system according to another aspect of the present invention.

Referring now to FIG. 10, the principles of the present invention are shown in an embodiment useful for modular partitions for use in an office environment. As in FIG. 1, a frame work is constructed of horizontal and vertical members (hidden from view) and modular panels 16 are attached thereto. However, because a partition 160 may be free standing, i.e. not be attached to a supporting wall or ceiling, caps 161, sills (not shown), edges 163, and corner pieces 165 are used to provide additional structural rigidity and to provide a more aesthetic and finished look to the visible edges of partition 160. A power source for partition 160, may be located between panels 16 on opposing sides of partition 160.

Shown attached to partition 160 are desks 162 and book shelf or cabinet 164. The power provided by vertical members may be used advantageously to provide internal illumination for the surface of desks 162, making them suitable for viewing x-rays or photographic slides. Alternatively, a light box, similar to light box 34 of FIG. 1, may be installed in partition 160 for viewing x-rays and other transparent media. Although not shown, light box 34 of FIG. 1 is attached to modular wall unit 10 using brackets substantially identical to brackets 138 of FIG. 8. Auxiliary power strip 168 provides a convenient method for attaching and powering desk lamp 170 and copy holder 172, and other powered accessory items not shown, and may be used for non-powered objects as well. Additionally, bookshelf or cabinet 164 may obtain electrical power from partition 160 to energize under-shelf light fixture 166 to provide suitable task lighting for desks 162. A spot-light 26 may also obtain power from partition 160.

Figure 11:
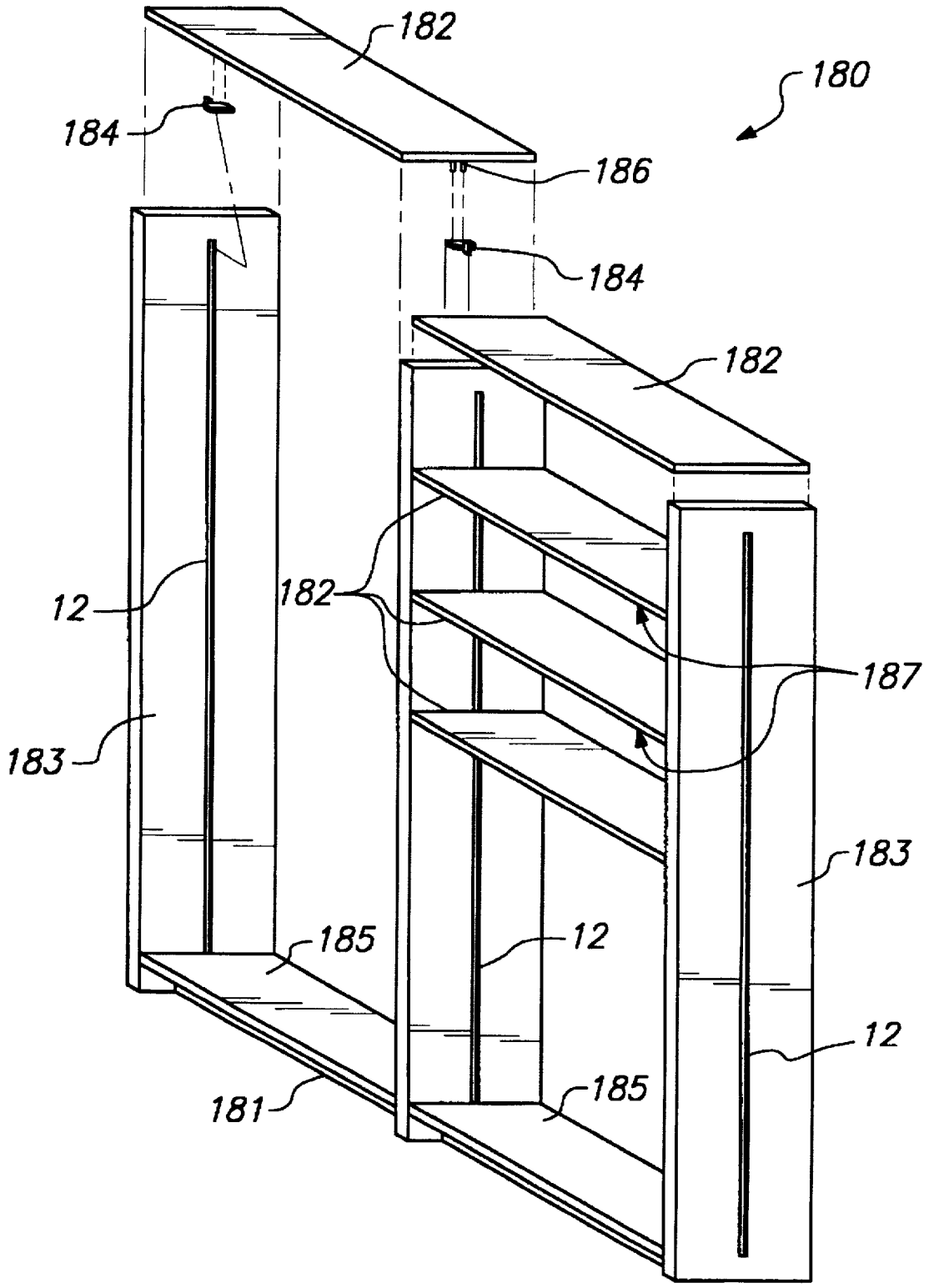
FIG. 11 depicts a perspective view of a bookcase constructed in accordance with yet after aspect of the invention.

Yet another embodiment of the present invention is shown by way of bookcase 180, shown in FIG. 11. Bookcase 180, which may be either free standing or attached to a supporting wall, includes base 181, vertical sides 183 and shelves 182 and 185. Vertical members 12 are mounted into grooves or slots in vertical sides Shelves 182, which may be adjustable or fixed, are supported by shelf supports 184 attached to vertical members 12. Shelves 182 which may be adjustable or fixed 187 (see FIG. 12). Shelf supports 184 include a portion shaped like bracket 23 of FIG. 4A for engaging vertical members 12 and a block portion for supporting shelves 182. A power supply (not shown) for bookcase 180 may be hidden within base 181.

Figure 12:
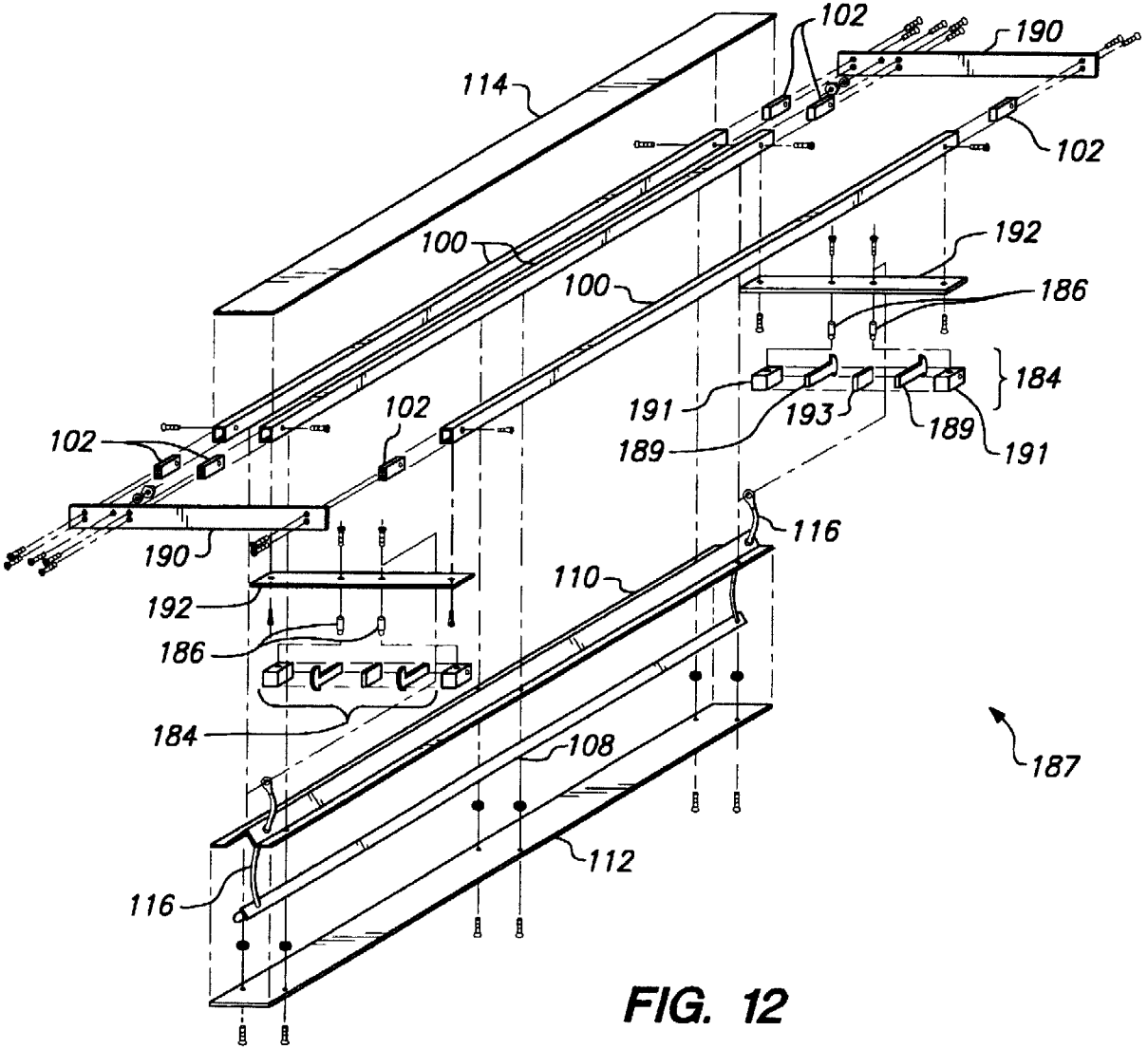
FIG. 12 shows a lighted shelf for use in the bookcase of FIG. 11.

Under-shelf light fixture 187 for use with bookcase 180, and shelf supports 184 for supporting shelves 182 are shown in more detail in FIG. 12. Light fixture 187 is similar in many respects to light fixture 106 of shelf support 18 discussed hereinabove in connection with FIG. 6, including cross members 100, insulators 102, light strip 108, reflector 110, bezel 112, heat reflector 114, and connecting wires 116. However, in FIG. 12 support bracket 23 of FIG. 6 is replaced by end pieces 190 and 192 which form an L-shaped unit. Shelf supports 184 comprise small brackets 189, shaped like the right hand portion of bracket 23 of FIG. 6, and spacer 193 which separates brackets 189 so that they may properly engage corresponding slots in vertical member 12. Blocks 191 are affixed to brackets 189 to provide a ledge for supporting shelves 182. Blocks 191 also include a socket mounted in their upper surface, wherein the socket is electrically connected to brackets 189. Pins 186 projecting downwardly from end piece 192 of light fixture 187 to provide electrical coupling between end piece 192 and the sockets in support brackets 189 and prevent shelf 182 from sliding off of bracket 184.

Figure 13A:
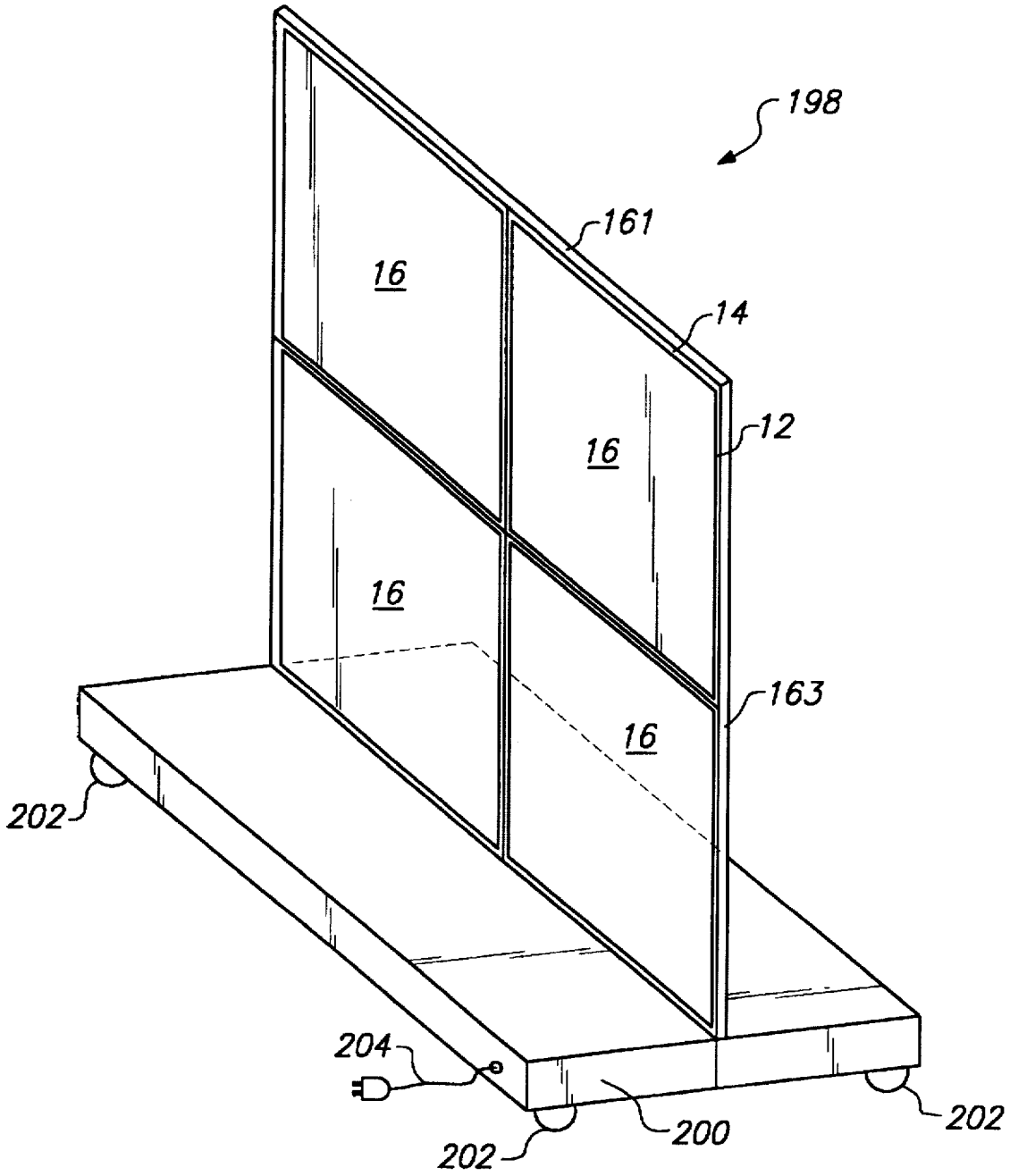
FIG. 13A and 13B are perspective views of a mobile display unit constructed in accordance with the principles of the present invention.
Figure 13B:
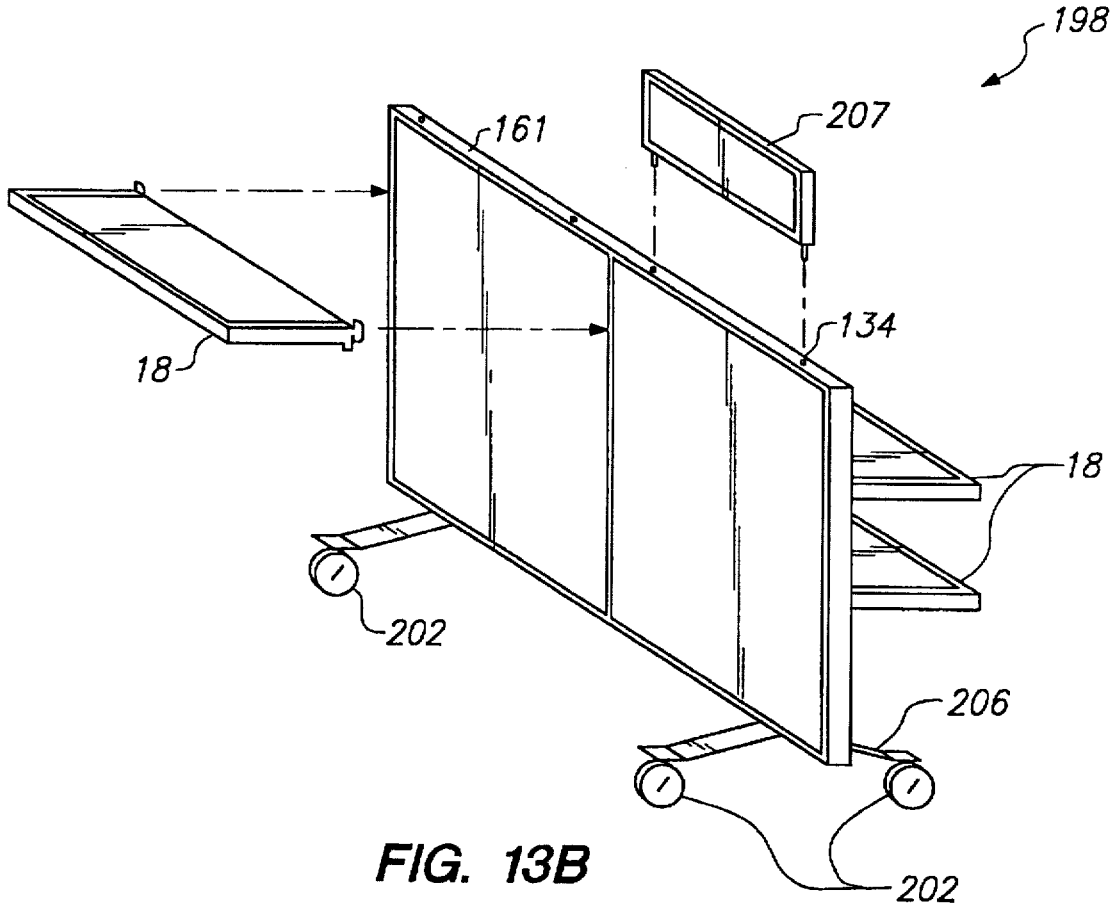

Referring now to FIGS. 13A and 13B still another embodiment of a display unit in accordance with the present invention is shown. Free-standing display unit 198 includes a frame work of vertical and horizontal members (12 and 14, respectively) and panels 16 as shown in the display system of FIG. 1, as well as trim pieces 161 and 163 as shown attached to partition 160 of FIG. 10. In FIG. 13A, free-standing display unit 198 is supported by base 200, which may include wheels, or casters, 202 for improved mobility, or may be used without wheels 202 when a semi-permanent installation is desired. Alternatively, display 198 may be supported by casters 202 attached to legs 206 as shown in FIG. 13B. Also shown in FIG. 13B, cap 161 may have sockets similar to socket 134 of FIG. 9 for the attachment of small lights, signs 207, and the like. Other furniture pieces such as shelves 18 and rack 20 can be attached to free-standing display 198.

In addition, free-standing display unit 198 of FIG. 13A may have a power supply for the display system hidden within base 200, so that free-standing display 198 may advantageously be moved to any convenient location with relative ease and energized by plugging power cord 204 into a nearby outlet. Alternatively, base 200 may also include batteries or power cells and the like to permit free-standing display 198 to be used in areas removed from electrical outlets for limited periods of time.

Figure 14A:
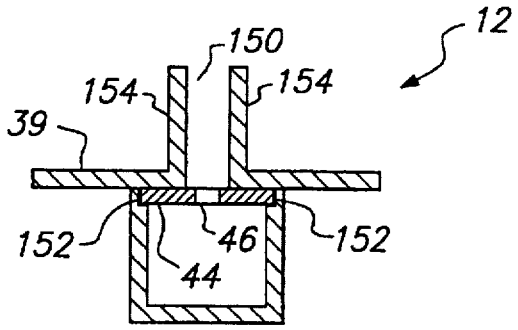
FIG. 14A, 14B, and 15 show alternative embodiments of vertical member 12 of FIG. 1.
Figure 15:
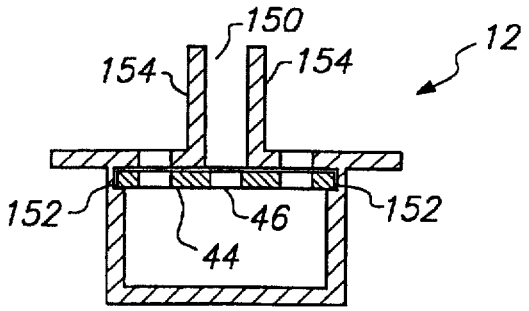
Figure 14B:
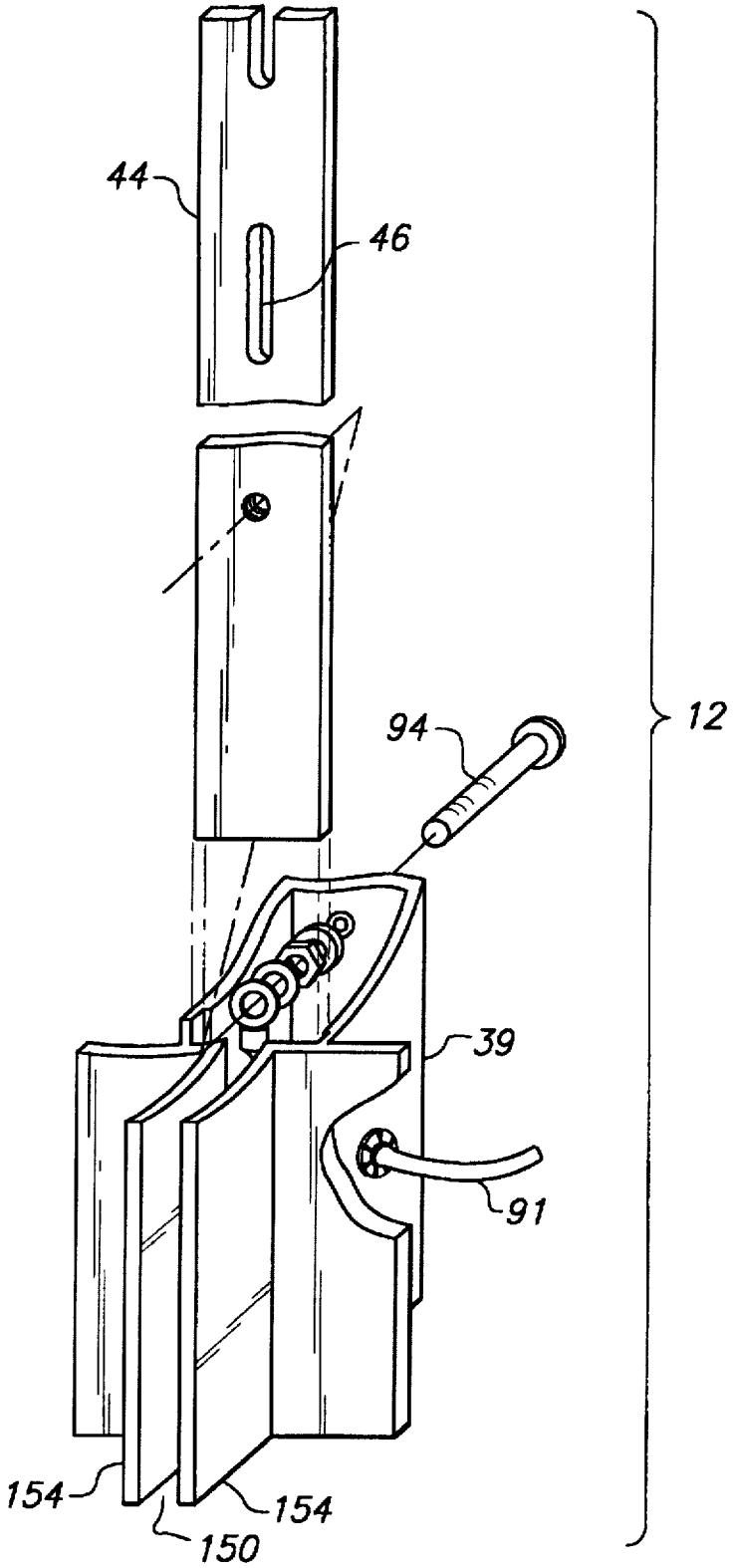

Referring to FIGS. 14A and 14B, an alternative embodiment of vertical members 12 is described. In this embodiment, supporting member 39 is generally shaped like a channel having an open side defining opening 150, and conductor 44 is generally shaped like an elongated bar or plate. Conductor 44 has a series of slots 46 spaced along its length such that the slots are aligned with opening 150. Conductor 44 is received into slots 152 on the inside of supporting member 39, which hold the conductor in a position set back from opening 150. Thus, when bracket 23 (FIGS. 1 and 3A–3C) is engaged in slot 46 in conductor 44, conductor 44 vertically supports bracket 23 in a cantilevered fashion, while extensions 154 of vertical member 12 provide lateral support. Power is supplied to conductor 44 by wire 91 as shown in FIG. 14B. Although wire 91 is shown bolted to conductor 44 in a manner similar to that shown in FIG. 5A, the embodiment of vertical member 12 shown in FIG. 14B may also be coupled to a power supply as shown in FIG. 5B. A similar embodiment of vertical member 12, shown in FIG. 15, includes additional slots or holes 157 in a face of supporting member 39 to provide a means of energizing horizontal member 14.

Figure 16:
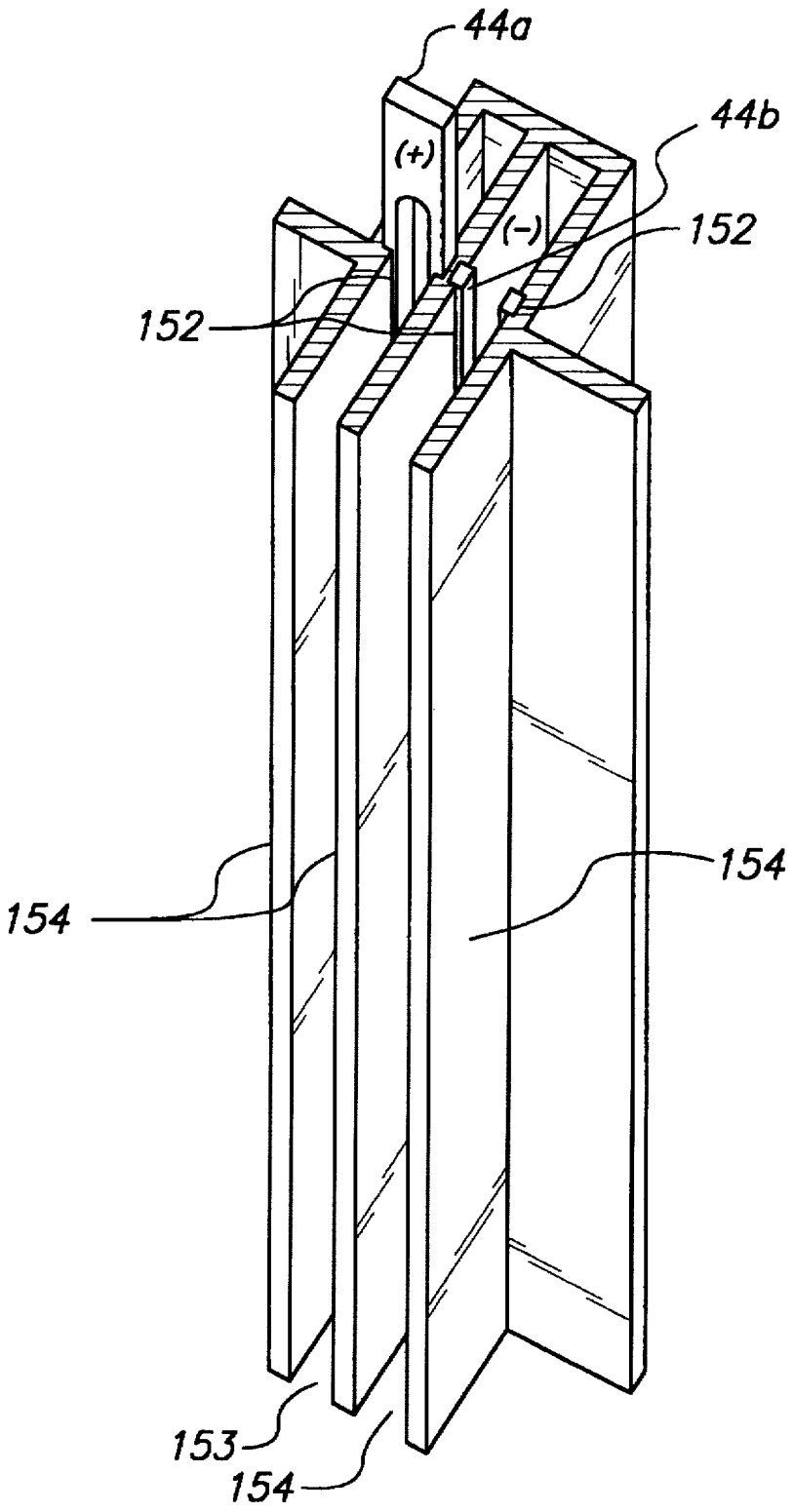
FIG. 16 shows a dual polarity embodiment of vertical member 12 of FIG. 1.

Yet another embodiment of vertical member 12 is shown in FIG. 16, wherein supporting member 39 defines a pair of adjacent channels 153 and 154. Conductors **44*a* and 44*b* are mounted into slots 152 located on the inside of, and set back from the opening in, channels 153 and 155. This embodiment of vertical member 12** may thus provide multiple voltages or multiple voltage polarities in a single vertical member.

One skilled in the art will thus appreciate that the present invention can be practiced by other than the described embodiments, which are presented for purposes of illustration and not of limitation, and the present invention is limited only by the claims which follow.

We claim:

1. A vertical member for use in a modular furniture system, the system including a bracket for mounting a furniture piece thereto, the bracket comprising a structural member having a layer of conductive material disposed on the structural member and a layer of an insulative material disposed on at least a portion of the conductive layer, the vertical member comprising:

a support member having an opening for receiving a first end of the bracket; and a conductor disposed behind the opening in the support member, the conductor having an opening substantially aligned with the opening in the support member, so that when the first end of the conductive bracket is inserted through the opening in the support member the first end of the bracket also passes through the opening in the conductor and a portion of the conductive layer contacts a portion of the conductor.

2. The vertical member of claim 1 wherein the support member has a plurality of openings distributed along a length of the vertical member and the conductor has a plurality of openings, each aligned with a corresponding one of the openings in the support member.

3. The vertical member of claim 1 wherein:

the support member is channel-shaped having an open side, wherein the open side defines the opening for receiving the first end of the bracket; and the conductor has a plurality of openings distributed along a length thereof, each opening in the conductor being laterally aligned with the opening defined in the support member.

4. The vertical member of claim 1 wherein the vertical member comprises a metallic material with an insulative powder coating.

5. The vertical member of claim 1 wherein the supporting member comprises steel or aluminum, and the conductor comprises brass or copper.

6. The vertical member of claim 1 further comprising an end cap, the end cap including a conductive pin protruding therefrom, wherein the conductive pin is coupled to the conductor.

7. A support bracket for use in a modular furniture system, the modular furniture system including a plurality of vertical members, each having an opening in a face thereof, and an electrical conductor disposed behind the opening in the vertical member, the conductor having an opening aligned with the opening in the vertical member, the bracket comprising:

an arm having a first end adapted to be engaged in the opening in the vertical member;

a layer of conductive material disposed on the arm; and a layer of insulative material disposed on a portion of the conductive layer, so that when the first end is engaged in the opening in the vertical member a portion of the conductive layer at the first end makes an electrical contact with the electrical conductor.

8. The bracket of claim 7, wherein the arm is metal, the layer of conductive material is a nickel plating, and the insulative layer is a powder coating.

9. The bracket of claim 8, wherein the arm includes a second end adapted for mounting an electrical device thereto, there being an exposed portion of the conductive layer near the second end so that the electrical device may be coupled to the conductive layer.

10. A modular furniture system including:

a first vertical member comprising:

a structural element having an opening therein;

a conductive element disposed behind the opening in the structural element, wherein the conductive element has an opening substantially aligned with the opening in the structural element;

a first bracket, comprising:

an arm having a first end adapted to be engaged in the opening in the first vertical member;

a layer of conductive material disposed on the arm; and a layer of insulative material disposed on at least a portion of the conductive layer, so that when the first end of the arm is engaged in the opening in the first structural element the first end also extends through the opening in the conductive element and the exposed portion of the conductive layer makes electrical contact with the conductive element.

11. The modular furniture system of claim 10 further comprising:

a second vertical member substantially identical to the first vertical member, wherein the first and second vertical members are juxtaposed in a spaced apart, substantially parallel relation;

a second bracket substantially identical to the first bracket; and a modular furniture piece coupled between the first and second brackets, the first and second brackets being maintained in a spaced apart fashion so that the first ends of the first and second brackets may be engaged in the openings in the structural and conductive elements of the first and second vertical members, respectively.

12. The modular furniture system of claim 11 further comprising a low voltage power source coupled to the first and second vertical members so that the first and second members are of opposite electrical polarity.

13. The modular furniture system of claim 12 wherein the modular furniture piece is an electrical device coupled to the conductive layer of the first and second brackets, so that when the first and second brackets are engaged in the openings in the first and second vertical members, respectively, a circuit is completed from the power supply to the electrical device through the first vertical member and the first bracket and returning from the electrical device to the power supply through the second bracket and second vertical member.

14. The modular furniture system of claim 13 further comprising a horizontal member mechanically coupled between the first and second vertical members the horizontal member including a socket electrically coupled to the conductor of the first and second vertical members.

15. The modular furniture system of claim 14 wherein the horizontal member has pins disposed from both ends thereof, and wherein the pins provide electrical contact with a portion of the conductive elements of the first and second vertical members.

* * * * *

UNITED STATES PATENT AND TRADEMARK OFFICE

CERTIFICATE OF CORRECTION

PATENT NO. : 5,695,261

DATED : December 9, 1997

INVENTOR(S) : Bruce M. Slesinger, Thomas L. Collom, Frank Neidhardt

It is certified that error appears in the above-indentified patent and that said Letters Patent is hereby corrected as shown below:

At column 10, line 46, insert--,--after "members"

At column 3, line 1, change "&shelf" to--of shelf--

At column 3, line 19, delete "and"

At column 3, line 35, change "therein." to--therein;--

At column 3, line 66, insert--,--after "26"

At column 5, line 47, change "element" to--elements--

At column 6, line 34, insert--a--after "is"

At column 7, line 28, insert--183.--after "sides"

At column 7, line 30, change "which may be adjustable" to --may contain an under-shelf light fixture--

At column 7, line 31, delete "or fixed"

At column 8, line 43, change "155." to--154.--

Signed and Sealed this

Twelfth Day of September, 2000

*Attest:*

Q. TODD DICKINSON

*Attesting Officer*

*Director of Patents and Trademarks*